United States Patent [19]

Iijima et al.

[11] Patent Number: 4,521,507

[45] **Date of Patent: * Jun. 4, 1985**

[54] MULTI-LAYER LIGHT-SENSITIVE SILVER HALIDE COLOR PHOTOGRAPHIC MATERIAL

[75] Inventors: Toshifumi Iijima; Kiyoshi Yamashita, both of Hino, Japan

[73] Assignee: Konishiroku Photo Industry Co., Ltd., Tokyo, Japan

[ * ] Notice: The portion of the term of this patent subsequent to May 1, 2004 has been disclaimed.

[21] Appl. No.: 453,475

[22] Filed: Dec. 27, 1982

[30] Foreign Application Priority Data

Dec. 29, 1981 [JP] Japan ..... 56-212995

[51] Int. Cl.[3] ..... G03C 1/46; G03C 1/08

[52] U.S. Cl. ..... 430/503; 430/502; 430/506; 430/509; 430/571

[58] Field of Search ..... 430/509, 506, 503, 502, 430/571

[56] References Cited

U.S. PATENT DOCUMENTS

| | | | |
|---|---|---|---|
| 3,932,185 | 1/1976 | Matsuura | 430/496 |
| 4,144,071 | 3/1979 | Shiba et al. | 430/382 |
| 4,170,479 | 10/1979 | Usami | 430/509 |
| 4,370,410 | 1/1983 | Iijima et al. | 430/509 |
| 4,388,401 | 6/1983 | Hasebe et al. | 430/509 |
| 4,446,228 | 5/1984 | Honda et al. | 430/567 |

*Primary Examiner*—Mary F. Downey

*Attorney, Agent, or Firm*—Frishauf, Holtz, Goodman and Woodward

[57] ABSTRACT

There is provided a multi-layer light-sensitive silver halide color photographic material having plural silver halide emulsion layers having respective sensitivities to light at different spectral regions on a support, wherein at least 80% of the total number of silver halide grains contained in at least one of the light-sensitive silver halide emulsion layers having sensitivities to different spectral regions, comprise silver halide grains having grain sizes greater than 0.8 $\mu$ and silver halide grains smaller than 0.65 $\mu$.

The multi-layer silver halide color photographic material according to this invention exhibits improved sharpness of the color images formed.

20 Claims, No Drawings

MULTI-LAYER LIGHT-SENSITIVE SILVER HALIDE COLOR PHOTOGRAPHIC MATERIAL

This invention relates to a light-sensitive silver halide color photographic material, particularly to a light-sensitive silver halide color photographic material excellent in sharpness of the dye images formed.

Light-sensitive silver halide color photographic materials generally comprise a plurality of uniform coatings of light-sensitive silver halide emulsions having different color sensitivities with dry thicknesses of several microns provided on a support such as of cellulose triacetate or polyethyleneterephthalate. In such light-sensitive silver halide emulsions, there exist a large number of silver halide grains having grain sizes corresponding approximately to the wavelengths of visible rays and various crystal habits dispersed within a hydrophilic colloid such as gelatin having a refractive index smaller than that of silver halide. When a visible light is given in the vertical direction upon the layer surface of such a light-sensitive silver halide emulsion layer, such rays are known to be scattered by the silver halide grains within the layer. This is said to be a phenomenon caused on account of the aforesaid grain sizes comparable to the wavelengths of visible rays and the difference in refractive index between grains and the binder. The extent of scattering may vary depending on the number of grains per unit volume, grains sizes, grain size distribution and the difference in refractive index between the silver halide grains and the binder. Thus, the visible incident light entering the light-sensitive silver halide emulsion layer, even when entering vertically the silver halide emulsion, is subject to scattering within the light-sensitive silver halide emulsion layer, to result in so called vagueness in the image formed to lower sharpness of the image.

This phenomenon will appear markedly in an enlarged projection of an image or in an enlarged printing. As a consequence, the image which should be sharp as a matter of course suffers from vagueness, for example, at the outline of an edge image or at the minute portion of an image of texture, whereby the dye image quality is markedly damaged.

There have been proposed various methods to alleviate lowering of the image sharpness by light scattering as mentioned above.

For example, there have been employed the method in which diffusion of the scattered light within the layer in the direction parallel to the silver halide emulsion layer surface is minimized by making the film thickness of the silver halide emulsion as small as possible by such measures as making smaller the proportion of silver halide grains relative to the gelatin in a light-sensitive silver halide emulsion layer, making smaller the average grain size of silver halide grains in the light-sensitive silver halide emulsion layer to be used as the uppermost layer or reducing the amount of the binder in the light-sensitive silver halide emulsion, as the effective method for improving the sharpness of a green sensitive silver halide emulsion layer. Such a method involves vital drawbacks. For example, lowering of the sensitivity of the emulsion layers is generally brought about by making smaller grain sizes of a silver halide, and substantial reduction of a binder in emulsion layers accompanies reduction of a coupler quantity which can be added in the emulsion layer, which also results in lowering the sensitivity of the emulsion. Also, in light-sensitive color photographic materials, there is the method in which a green sensitive silver halide emulsion layer for forming a magenta color forming dye image with high specific visual sensitivity is provided by coating as the uppermost layer of a light-sensitive color photographic material. However, such a method also involves vital defects imparing basic performance of a light-sensitive color photographic material. That is, said green sensitive silver halide emulsion layer is also capable of being sensitive to the blue light region inherent in silver halide emulsions, which is not favorable for a green sensitive silver halide emulsion. It is generally desirable that only a blue sensitive silver halide emulsion should be sensitive to a blue light, and therefore such a phenomenon gives a vital defect in color reproduction of a light-sensitive color photographic material.

An object of this invention is to provide a light-sensitive silver halide color photographic material improved in sharpness of color images formed.

The present inventors have made extensive studies to alleviate deleterious influences on sharpness of images and consequently discovered a method to improve image sharpness by reducing scattering of light which cannot be expected from the techniques known in the art.

That is, the present inventors have found that the above objects can be accomplished in a multi-layer light-sensitive silver halide color photographic material having plural silver halide emulsion layers having respective sensitivities to the light at different spectral regions on a support, wherein at least 80% of the total number of silver halide grains in at least one silver halide emulsion layer having sensitivities to different spectral region comprise silver halide grains having grain sizes greater than $0.8\mu$ and silver halide grains smaller than $0.65\mu$.

In this invention, silver halide emulsion layers having sensitivities to the light at different spectral regions means a set of silver halide emulsion layers having respective sensitivities to electromagnetic energies comprising any desired individually different single wavelengths ($\lambda$) represented by $\lambda=h\nu$ (where $\lambda$ is a wavelength, $\nu$ is the number of vibrations and h is the Planck's constant), any desired individually different wavelength regions or any desired combinations thereof. When the light-sensitive silver halide color photographic material is constituted of a plural number of silver halide emulsions having respective sensitivities to wavelength regions different from each other, the sensitive spectral regions of respective silver halide emulsions may partially overlap each other.

According to an embodiment of this invention which is the most preferred, the light-sensitive silver halide color photographic material is constituted of a blue sensitive silver halide emulsion layer having sensitivity to light at the wavelength region (blue) of 400 to 500 $m\mu$ (hereinafter in this invention sometimes referred to briefly as blue sensitive emulsion layer or regular emulsion layer), a green sensitive silver halide emulsion layer having sensitivity to light at the wavelength region (green) of 500 to 600 $m\mu$ (hereinafter in this invention sometimes referred to briefly as green sensitive emulsion layer or ortho emulsion layer), and a red sensitive silver halide emulsion layer having sensitivity to light at the wavelength region (red) of 600 to 700 $m\mu$ (hereinafter in this invention sometimes referred to briefly as red sensitive emulsion layer or panchromatic emulsion layer).

In the so called false color photographic method, infrared energy informations are recorded as color images by use of a silver halide emulsion having sensitivity to non-visible regions, particularly the infrared region. This invention is also applicable for such a so called infrared color photographic method.

In this invention, each of these silver halide emulsion layers having sensitivities to the light at different spectral regions may be constituted of a single emulsion layer or alternatively at least any one of the silver halide emulsion layers may be constituted of a plural number of emulsion layers.

The light-sensitive silver halide color photographic material may be advantageously applied for a light-sensitive silver halide color photographic material of the type for which high sensitivity and high image quality are required, particularly preferably for a negative-type light-sensitive silver halide color photographic material for photographing of which primary negative image is subjected to enlarged printing to obtain a positive image or a reversal-type light-sensitive silver halide color photographic material for photographing (including light-sensitive silver halide color photographic materials for an 8 m/m projector) of which the positive color image is viewed by enlarged projection.

According to a preferred embodiment of this invention, in a multi-layer light-sensitive silver halide color photographic material having on a support a plural number of silver halide emulsion layers having sensitivities to the lights at the aforementioned spectral regions of blue, green and red, respectively, at least 80% of the total number of silver halide grains contained in one or plural light-sensitive silver halide emulsion layers having sensitivity to one spectral region located at the remotest side from the support are constituted of silver halide grains having grain sizes greater than 0.8$\mu$ and silver halide grains smaller than 0.65$\mu$.

According to another preferred embodiment of this invention, in a multi-layer light-sensitive silver halide color photographic material having on a support a plural number of silver halide emulsion layers having sensitivities to the light at the aforementioned spectral regions of blue, green and red, respectively, at least 80% of the total number of silver halide grains contained in one or a plural number of light-sensitive silver halide emulsion layers having sensitivity to green light are constituted of silver halide grains having grain sizes greater than 0.8$\mu$ and silver halide grains smaller than 0.65$\mu$.

According to a further preferred embodiment of this invention, in a multi-layer light-sensitive silver halide color photographic material having on a support a plural number of silver halide emulsion layers having sensitivities to the light at the aforementioned spectral regions of blue, green and red, respectively, at least 80% of the total number of silver halide grains contained in both the emulsion layer located at the remotest side from the support and the green sensitive emulsion layer (provided that the layer located at the remotest side from the support is not a green sensitive layer) are constituted of silver halide grains having grain sizes greater than 0.8$\mu$ and silver halide grains smaller than 0.65$\mu$.

According to a further preferred embodiment of this invention, in the aforesaid multi-layer light-sensitive silver halide color photographic material, at least 80% of the total number of silver halide grains contained in the light-sensitive silver halide emulsion layers having sensitivity to blue, green and red, respectively, are constituted of silver halide grains having grain sizes greater than 0.8$\mu$ and silver halide grains having grain sizes smaller than 0.65$\mu$.

In this invention, the proportion of silver halide grains having grain sizes greater than 0.8$\mu$ relative to those having grain sizes smaller than 0.65$\mu$ contained in a silver halide emulsion layer having a sensitivity to one spectral region depends on which one of the sensitivity of the light-sensitive material or the image quality of the final image is emphasized. Generally speaking, however, silver halide grains having grain sizes greater than 0.8$\mu$ are selected within the range from 5 to 95% and those having grain sizes smaller than 0.65$\mu$ within the range from 95 to 5%. When the sensitivity is of primary concern, the proportion of the grains having grain sizes greater than 0.8$\mu$ (hereinafter abbreviated as greater grains) is made greater, while the proportion of the grains having sizes smaller than 0.65$\mu$ (hereinafter abbreviated as smaller grains) is made smaller in a light-sensitive material for which high image quality is required rather than high sensitivity. According to the most preferred embodiment of this invention, the proportion of greater grains is made 5 to 30% and that of smaller grains 95 to 70%.

In this invention, the above greater grains and smaller grains to be contained in a silver halide emulsion layer having sensitivity to one spectral region may be contained as a mixture in a single layer or alternatively constituted as separate layers. When the greater grains and the smaller grains are to be constituted as separate layers, the layer containing the greater grains is generally arranged on the side farther from the support (namely the side of incident light at the time of photographing) from the point of view to make much of sensitivity, but it is also possible to arrange the layer containing the smaller grains on the incident light side particularly when the priority is given to image quality.

The silver halide grains to be used in the light-sensitive color photographic material according to this invention may be so called twin crystals having irregular shapes such as spheres or plates, or they may also be normal crystals. However, the effect of this invention can be exhibited more markedly when normal crystalline grains are employed.

According to a preferred embodiment of this invention, 80% of the total number of grains, more preferably substantially all of the grains, contained in the aforesaid silver halide emulsion according to this invention are constituted of normal crystalline grains.

In this invention, silver halide grains of normal crystals mean silver halide crystalline grains in the regular shapes with the outer crystal habits of silver halide crystals consisting substantially only of [1 0 0] planes and/or [1 1 1] planes, namely a concept as contrasted to twin crystals. For example, representative normal crystals of silver halide grains of this invention include silver halide crystals having regular shapes such as cubic, octahedral or tetradecahedral bodies.

The normal crystalline silver halide emulsions to be used in the multi-layer light-sensitive silver halide color photographic material according to this invention may be used either singly as cubic, octahedral or tetradecahedral crystalline grains, or as a mixture of any desired combination of these crystals. It is preferred, however, that the proportion of octahedral and/or tetradecahedral crystals may be greater than cubic crystals. More preferably, the crystals may be constituted only of octahedral grains and/or tetradecahedral grains.

The silver halide composition in the silver halide emulsion according to this invention is not particularly limited, but a range conventionally used may be applicable. For example, when applying for a negative emulsion for general photographing or a reversal emulsion for photographing, there may preferably be employed a composition composed principally of silver bromide containing 12 mole % or less of silver iodide, which may also contain 10 mole % or less of silver chloride. On the other hand, for an emulsion to be used for print for which good developing characteristics are required, while permitting relatively lower sensitivity, there may be employed compositions of silver chlorobromide, silver chlorobromide composed principally of silver chloride, silver chloroiodobromide, etc. According to the most preferred embodiment of this invention, all of the light-sensitive emulsion layers constituting the multi-layer light-sensitive silver halide color photographic material according to this invention are constituted of silver iodobromide grains containing 4 mole % or less of silver iodide substantially of octahedral and/or tetradecahedral grains. By such a constitution, there can be obtained a multi-layer light-sensitive silver halide color photographic material reduced in exposed silver halide grains contributing nothing to development (dead grains) at the time of developing, which is high in developing characteristics and therefore high in sensitivity, and capable of giving a color image of high quality.

The silver halide grains to be used in the light-sensitive silver halide emulsion layers constituting the multi-layer light-sensitive silver halide color photographic material according to this invention may be so called monodispersed type wherein individual grain sizes vary little or polydispersed type wherein the vary widely. However, a monodispersed emulsion can give a particularly marked effect obtained in this invention. Particularly, it is preferred that the value of the standard deviation S as defined by the following formula divided by the mean grain diameter may be 0.15 or less.

$$S = \sqrt{\frac{\Sigma (\bar{r} - r_i)^2 n_i}{\Sigma n_i}}$$

$$\frac{S}{\bar{r}} \leqq 0.15$$

The mean grain diameter herein mentioned means a mean value of diameters of spheres when silver halide grains are spherically shaped or diameters of spherical images calculated to have the same area as the projected images of the shapes other than spheres such as cubic bodies when they are in the form of such shapes, and $\bar{r}$ is defined by the following formula when individual grains have sizes of $r_i$ in number of $n_i$:

$$\bar{r} = \frac{\Sigma n_i r_i}{\Sigma n_i}$$

The silver halide grains to be used in the light-sensitive silver halide photographic material according to this invention may be prepared according to any of the acidic method, the neutral method or the ammonia method. For example, seed grains may be produced by the acidic method, and further growth of the grains may be performed by the ammonia method, in which the growth rate is faster, to desired grain sizes. In growth of silver halide grains, it is desireable to control pH, PAg, etc. in the reactor and to inject and mix successively silver ions and halide ions at the same time in amounts corresponding to the growth rate of silver halide grains as disclosed in Japanese Provisional Patent Publication No. 48521/1979.

The silver halide grains of this invention may incorporate noble metal ions such as of Ir, Rh, Pt or Au internally within the grains by adding such ions in the course of the growth of grains, and it is also possible to impart reduction sensitized nuclei within the grains by using a low pAg atmosphere or an appropriate reducing agent.

The silver halide emulsion of this invention may be made to have a pAg or an ion concentration suitable for chemical sensitization according to an appropriate method after completion of the growth of silver halide grains. For example, it may be practiced by, for example, the agglomeration method, the Noodle water washing method, as disclosed in Research Disclosure No. 17643.

In this invention, the monodispersed silver halide emulsion may be used as such or two kinds or more of monodispersed emulsions with different mean grain diameters may be blended at any time after formation of grains and provided for use.

In this invention, when two or more kinds of emulsions with different mean diameters are used in combination, it is desirable that chemical sensitizations suitable for respective emulsions should be individually applied. Chemical sensitization mentioned here means a known sensitization such as sulfur sensitization, gold sensitization, selenium sensitization, reduction sensitization, etc. and a combination of these may also be practiced. Since the reaction rate differs depending on the grain size of the silver halide, when sensitization is effected after blending without applying the same method or without conducting sensitization individually, the maximum rates of individual emulsions cannot necessarily be obtained.

In the above chemical sensitization in this invention, sulfur sensitization may be conducted by use of, for example, sodium thiosulfate, thiourea, allylthiourea, etc., or gold sensitization by use of, for example, sodium chloroaurate, potassium aurithiocyanate, etc. Also, as the gold-sulfur sensitization, chemical sensitization may be effected by using at least one kind of each of the above sensitizers. In this case, it is also possible to effect chemical sensitization by further adding ammonium thiocyanate, etc. to said sensitizers.

For the silver halide emulsion to be used in the present invention, other than the above sulfur sensitizing method, etc., there may also be employed the selenium sensitizing method. For example, there may be employed the methods in which N,N'-dimethylselenourea, and others are used, as disclosed in U.S. Pat. Nos. 1,574,944 and 3,591,385, Japanese Patent Publication Nos. 13849/1968 and 15748/1969.

As the reduction sensitization, a method well known in the art may be applicable. For example, it may be practiced by aging with a low pAg atmosphere, or by use of an appropriate reducing agent or an electromagnetic wave such as light, gamma-ray, etc.

The support to be used in the multi-layer light-sensitive silver halide color photographic material of this invention may include all materials known in the art, as exemplified by semi-synthetic polymers such as cellulose triacetate, polyester films such as of polyethyleneterephthalate, polyamide films, polycarbonate films, styrene films, or baryta paper, papers coated with synthetic polymers, etc. As a light-sensitive material for photographing, a transparent support is generally employed.

In this invention, as the hydrophilic colloid in which silver halide grains are to be dispersed, gelatin is the most preferable. For further improvement of binder characteristics, there may also be employed, for example, gelatin derivatives; other natural hydrophilic colloids such as albumin, casein, agar, gum arabic, alginic acid and its derivatives (e.g. salts, amides and esters), starch and its derivatives, cellulose derivatives (e.g. cellulose ether, partially hydrolyzed cellulose acetate, carboxymethyl cellulose, etc.); or synthetic hydrophilic resins such as polyvinyl alcohol, polyvinyl pyrrolidone, homo- and copolymers of acrylic acid and methacrylic acid or derivatives thereof (e.g. esters, amides, nitriles), vinyl polymers (e.g. vinyl ether and vinyl ester).

The silver halide emulsion to be used in the light-sensitive silver halide photographic material according to this invention may also contain stabilizers, antifoggants as disclosed in U.S. Pat. Nos. 2,444,607, 2,716,062, 3,512,982, and 3,342,596; German Pat. Nos. 11 89 380, 2 05 862 and 2 11 841; Japanese Patent Publications Nos. 4183/1968 and 12825/1964; and Japanese Provisional Patent Publications Nos. 22626/1975 and 25218/1975. As particularly preferable compounds, there may be mentioned 5,6-trimethylene-7-hydroxy-8-triazolo(1,5-a)-pyrimidine, 5,6-tetramethylene-7-hydroxy-8-triazolo-(1,5-a)pyrimidine, 5-methyl-7-hydroxy-8-triazolo(1,5-a)pyrimidine, 7-hydroxy-8-triazolo(1,5-a)pyrimidine, gallic acid esters (e.g. isoamyl gallate, dodecyl gallate, propyl gallate, sodium gallate, etc.), mercaptans (e.g. 1-phenyl-5-mercaptotetrazole, 2-mercaptobenzthiazole, etc.), benztriazoles (e.g. 5-bromobenztriazole, 4-methylbenztriazole, etc.), benzimidazoles (e.g. 6-nitrobenzimidazole), and so on.

The silver halide emulsion of this invention can be spectrally sensitized with known spectral sensitizing dyes such as cyanine dyes or melocyanine dyes according to the known methods. For example, in the regular region, there may be employed sensitizing dyes as disclosed in Japanese Provisional Patent Publications Nos. 2756/1980 and 14743/1980, while in the ortho region those as disclosed in Japanese Provisional Patent Publications Nos. 56425/1973 and 31228/1976, and Japanese Patent Publication No. 25379/1972, either individually or as a combination of two or more kinds. Spectral sensitization at further longer wavelength side may also be conducted with the use of, for example, a cyanine dye with further longer methynes as disclosed in Japanese Provisional Patent Publication No. 126140/1976, and it is also possible to perform ultra-color sensitization by use of a combination of dyes, etc. as desired.

The light-sensitive silver halide photographic material of this invention may incorporate in its coating solution film hardeners conventionally used for photography, including, for example, aldehyde type, aziridine type (e.g. those disclosed in PB Report 19,921, U.S. Pat. Nos. 2,950,197, 2,964,404, 2,983,611 and 3,271,175, Japanese Patent Publication No. 40898/1971, Japanese Provisional Patent Publication No. 91315/1975), isooxazole type (e.g. those disclosed in U.S. Pat. No. 331,609), epoxy type (e.g. those disclosed in U.S. Pat. No. 3,047,394, German Pat. No. 10 85 663, U.K. Pat. No. 1033518 and Japanese Patent Publication No. 35495/1973), vinyl sulfone type (e.g. those disclosed in PB Report 19,920, German Pat. No. 11 00 942, U.K. Pat. No. 1251091, Japanese Patent Applications Nos. 54236/1970 and 110996/1973, U.S. Pat. Nos. 353,964 and 3,490,911), acryloyl type (e.g. those disclosed in U.S. Pat. No. 2,938,892, Japanese Patent Publication No. 38715/1971 and Japanese Patent Application No. 15095/1974), or otherwise film hardeners of maleimide type, acetylene type, methanesulfonic acid ester type, triazine type, and polymeric type. It is also possible to employ thickeners as disclosed in U.S. Pat. No. 3,167,410 and Belgian Pat. No. 558,143), polyols as gelatin plasticizers (e.g. those disclosed in U.S. Pat. No. 2,960,404, Japanese Patent Publication No. 4939/1978 and Japanese Provisional Patent Publication No. 63715/1973), latices disclosed in U.S. Pat. No. 766,976, French Pat. No. 13 95544 and Japanese Patent Publication No. 43125/1973, and matting agents as disclosed in U.K. Pat. No. 1221980.

In the constituent elements of the light-sensitive silver halide photographic material according to this invention, there may be employed any desired coating aid, for example, saponins or sulfosuccinic acid surfactants such as those disclosed in U.K. Pat. No. 548532 or Japanese Patent Application No. 89630/1972 or anionic surfactants such as those disclosed in Japanese Patent Publication No. 18156/1968, U.S. Pat. No. 3,514,193, French Pat. No. 20 25688 or Japanese Patent Publication No. 10247/1968.

In the light-sensitive silver halide photographic material according to this invention, dyes may be employed in the layer beneath the emulsion layer of this invention in contact with the support, or alternatively dyes may be added for improvement of sharpness of the images or alleviation of fogging caused by safety light into the protective layer and/or the emulsion layer of this invention and/or the non-sensitive layer contacted with the emulsion layer of this invention. And, as such dyes, there may be employed all of the known dyes for the above purposes.

For application of the emulsion of this invention for light-sensitive materials, there may be employed the methods and the materials to be used for light-sensitive materials for general color in which cyan, magenta and yellow couplers are incorporated in combination into the emulsion of this invention prepared to be red sensitive, green sensitive and blue sensitive or for false color light-sensitive materials as disclosed in Imaging No. 18~19 (1976).

Useful couplers may include open-chain methylene type yellow couplers, pyrazolone type magenta couplers, phenol type or naphthol type cyan couplers, and there may be employed, in combination with these couplers, colored couplers (e.g. couplers in which split-off groups having azo groups are bonded as binding group to the active site of the coupler), oxazone type compounds, developing diffusive dye releasing type couplers, developing inhibitor releasing type compounds (including both of so called DIR couplers which are compounds capable of releasing developing inhibitor type compounds through the reaction with an oxidized product of an aromatic primary amine developing agent and forming a colored dye through the reaction with an oxidized product of an aromatic primary amine developing agent, and DIR substances which form colorless compounds), etc. For incorporation of these couplers in the light-sensitive silver halide color photographic materials, various techniques known in the art conventionally used for couplers may be applicable.

In this invention, particularly useful yellow couplers may include α-acylacetamide yellow couplers. These couplers are disclosed in, for example, German Provisional Patent Publication Nos. 20 57 941 and 21 63 812, Japanese Provisional Patent Publication Nos. 26133/1972 and 29432/1973, U.S. Pat. Nos. 3,227,550, 2,875,057 and 3,265,506, Japanese Provisional Patent Publication Nos. 66834/1973, 66835/1973, 94432/1973, 1229/1974, 10736/1974, 34232/1975, 65231/1975, 117423/1975, 3631/1976 and 50734/1976.

These α-acylacetamide yellow couplers may be used individually or as a mixture of two or more kinds and incorporated in the silver halide emulsion layer according to the methods as mentioned above at a proportion of 5 to 30 moles per mole of silver halide.

The magenta couplers which may be preferably used in this invention may include couplers as disclosed in, for example, U.S. Pat. Nos. 3,311,476, 3,419,391, 3,888,680 and 2,618,641, German Provisional Patent Publication Nos. (OLS) 20 15 814, 23 57 102 and 23 57 122, Japanese Provisional Patent Publication Nos. 129538/1974, 105820/1976, 12555/1974, 48540/1979, 112342/1976, 112343/1976, 108842/1976 and 58533/1977, and these couplers may be synthesized according to the methods disclosed in said specifications or similar methods.

The cyan couplers preferably employed in this invention may include those as disclosed in, for example, U.K. Pat. No. 1084480, Japanese Provisional Patent Publication Nos. 117422/1975, 10135/1975, 37647/1976, 25228/1975, and 130441/1975. These cyan couplers may be incorporated, either individually, as a mixture of two or more kinds or as a mixture with a so called colored coupler of the arylazo type substituted at the active site as disclosed in U.S. Pat. No. 3,034,892, according to a conventional method in the silver halide emulsion layer in an amount of 5 to 30 moles per mole of silver halide.

The DIR compounds which can be preferably used in the light-sensitive color photographic material of this invention may be represented by the following formula (I) or (II).

Formula (I):

A—TIME—Z

In the above formula, A is a coupling component which can react with an oxidized product of a color forming developing agent, and it may be any component, so far as it can liberate TIME—Z by reacting with an oxidized product of a color forming developing agent.

TIME is a timing group and Z a development inhibitor. As the timing group, there may be mentioned those obtained by the intramolecular nucleophilic substitution reaction as disclosed in Japanese Provisional Patent Publication No. 145135/1979 or those obtained by the electron transfer along the conjugated chain as disclosed in Japanese Provisional Patent Publication No. 17644/1980. In short, any compound may be available which can first liberate a TIME—Z group through cleavage of the linkage of A—TIME and then liberate Z through cleavage of the linkage of TIME—Z. Z may include the development inhibitors as disclosed in Research Disclosure Vol. 176, No. 17643, December, 1978 (hereinafter referred to as Literature 1), preferably mercaptotetrazole, selenotetrazole, mercaptobenzothiazole, selenobenzothiazole, mercaptobenzooxazole, selenobenzooxazole, mercaptobenzimidazole, selenobenzimidazole, benzotriazole, benzodiazole and derivatives thereof.

Formula (II):

A—Z wherein A and Z represent the same groups as in case of the formula (I).

The DIR compounds represented by the formula (I) can be synthesized according to the methods as disclosed in Japanese Provisional Patent Publications Nos. 145315/1979, 17644/1979 and others.

The DIR compounds represented by the formula (II) are inclusive of DIR couplers and DIR substances.

As DIR couplers, there may be included those as disclosed in, for example, U.S. Pat. Nos. 3,227,554 and 3,773,201, and U.K. Pat. No. 2010818. The synthetic methods are also disclosed in these specifications.

As DIR substances, there may be included those as disclosed in U.S. Pat. Nos. 3,958,993, 3,961,959 and 3,938,996, Japanese Provisional Patent Publication Nos. 147716/1975, 152731/1975, 105819/1976, 6724/1976 and 123025/1975, U.S. Pat. Nos. 3,928,041 and 3,632,345, and Japanese Provisional Patent Publication No. 125202/1975, etc., and their synthetic methods are also disclosed in these specifications.

The light-sensitive silver halide photographic material can be subjected to developing treatment according to the known method conventionally used. The bleaching developing solution may be a conventionally used developing solution, containing, for example, hydroquinone, 1-phenyl-3-pyrazolidone, N-methyl-p-aminophenol or p-phenylenediamine, singly or as a combination of two or more kinds. As other additives, there may be employed those which are conventionally used. When said light-sensitive material is for color photography, color forming development may be performed in a conventional manner.

A developing solution containing an aldehyde film hardener may also be used in the light-sensitive silver halide according to this invention. For example, it is possible to use a developing solution well known in the field of photography, containing maleic dialdehyde or tartaraldehyde and sodium bisulfite salts thereof.

The present invention is described in detail below by referring to the Examples, by which the present invention is not limited.

Detection of the improved effect of image sharpness was conducted by determining MTF (Modulation Transfer Function) of dye images and comparing relative values (to Control sample as 100) of MTF at the space frequencies of 10 lines/mm and 30 lines/mm.

Graininess was evaluated by comparison of 1000-fold value of the standard deviation difference of the fluctuations of the density value occurring when scanning a dye image with a dye image density of 1.0 by means of a microdensitometer with a circular scanning bore diameter of 25μ, in terms of the relative value to Control sample as 100.

First, the methods for preparation of the emulsions employed in Examples are shown below.

Preparation of a polydispersed emulsion

Aqueous solutions of ammoniacal silver nitrate and an alkali halide were permitted to fall naturally into a reactor maintained at 60° C. in which an aqueous gelatin solution and an excessive halide had been previously added. Then, desalination was effected with the use of benzenesulfonylchloride, followed by addition of gelatin, to prepare an emulsion of pAg 7.8 and pH 6.0. Further, sodium thiosulfate, a metal chloride and ammonium bromide were added, and chemical aging was conducted at 52° C. for 70 minutes, followed by addition of 4-hydroxy-6-methyl-1,3-3a,7-tetrazaindene and 6-nitrobenzimidazole, further by addition of gelatin, to prepare a polydispersed silver iodobromide emulsion. By varying the alkali halide composition, the silver halide mole % was varied, while by varying the time at which the aqueous solutions of ammoniacal silver nitrate and the alkali halide were added, the average grain size and the grain size distribution were varied.

Preparation of monodispersed emulsions

To a reactor into which potassium iodide and an aqueous gelatin solution had been previously added, while maintaining pAg in the reactor at 8.6, there were added an aqueous ammoniacal silver nitrate solution and an aqueous potassium bromide solution in proportion to the increase of the surface area at the time of growth of grains. Then, desalination was effected with the use of benzenesulfonylchloride to prepare an emulsion of pAg 7.8 and pH 6.0. Further, chemical aging was performed with addition of sodium thiosulfate, chloroauric acid and ammonium rhodanate, followed by addition of 4-hydroxy-6-methyl-1,3,3a,7-tetrazaindene and 6-nitrobenzimidazole, further by addition of gelatin, to prepare a monodispersed silver iodobromide emulsion. Also, the forms of silver halide grains were controlled by varying pAg, the silver iodide mole % was controlled by varying the ratio of potassium iodide to potassium bromide, and the grain size was varied by varying the amount of ammoniacal silver nitrate and potassium halide added. Based on the finding intentionally made of the proportional relationship between the rate of addition of the aqueous ammoniacal silver nitrate solution and the aqueous potassium bromide solution and the rate of increase of the surface area at the time of growth of grains, there was prepared a silver iodobromide emulsion having a broader grain size distribution than the monodispersed emulsion according to the present invention and a narrower grain size distribution than the aforesaid polydispersed emulsion.

Table 1 shows the contents, types of crystals, average grain sizes [$\mu$] and grain size distributions ($r<0.65\mu$, $0.65\mu \leqq r \leqq 0.8\mu$ and $0.8\mu<r$; where r is the grain size, and the respective values show the percentage of the number contained (when grain sizes of 500 grains in each silver halide emulsion are measured) of the silver iodides in the silver iodobromides emulsions employed in the Reference example and Examples.

TABLE 1

| Emulsion No. | Content of silver iodide (mole %) | Type of crystal | Mean grain size ($\bar{r}[\mu]$) | Grain size distribution $r < 0.65$ | $0.65 < r < 0.8$ | $0.8 < r$ |
|---|---|---|---|---|---|---|
| Em - 1 | 4 | Twin | 0.71 | 47 | 31 | 22 |
| Em - 2 | " | " | 0.95 | 14 | 28 | 58 |
| Em - 3 | " | Normal (cubic) | 0.53 | 96 | 4 | 0 |
| Em - 4 | " | " | 0.72 | 16 | 74 | 10 |
| Em - 5 | " | " | 0.95 | 0 | 5 | 95 |
| Em - 6 | " | Normal (octahedral) | 0.52 | 98 | 2 | 0 |
| Em - 7 | " | " | 0.71 | 20 | 73 | 6 |
| Em - 8 | " | " | 0.97 | 0 | 6 | 94 |
| Em - 9 | " | Normal (tetradecahedral) | 0.52 | 98 | 2 | 0 |
| Em - 10 | " | Normal (tetradecahedral) | 0.71 | 21 | 72 | 7 |
| Em - 11 | " | Normal (tetradecahedral) | 0.95 | 0 | 5 | 95 |

Reference example

As a magenta coupler, 15 g of 1-(2,4,6-trichlorophenyl)-3-[3-(2,4-di-t-amylphenoxyacetamido)benzamido]-5-pyrazolone and 0.6 g of the DIR compound (A) as shown below were dissolved in 30 ml of ethyl acetate and 15 ml of dibutyl phthalate. The resultant solution was mixed with 20 ml of a 10% aqueous solution of Alkanol B (alkylnaphthalenesulfonate, produced by E. I. Du Pont de Nemours & Company) and 200 ml of an aqueous 5% gelatin solution, followed by emulsifying and dispersing by means of a colloid mill. The dispersion was added to 1 kg of a green sensitive silver iodobromide emulsion as shown in the foregoing Table 1 (sensitized to green color with the use of a dye) and the mixture was coated on a triacetate base having a halation preventive layer to a silver quantity of 20 mg/dm$^2$ and dried, to prepare Samples (1) to (11).

The above five samples were separately contacted with transparent square wave charts or wedges, subjected to green light exposure and treated according to the following treatment steps to obtain samples having dye images, respectively.

| Treatment step (38° C.) | Treatment time |
|---|---|
| Color forming developing | 3 min. 15 sec. |
| Bleaching | 6 min. 30 sec. |
| Washing with water | 3 min. 15 sec. |
| Fixing | 6 min. 30 sec. |
| Washing with water | 3 min. 15 sec. |
| Stabilizing | 1 min. 30 sec. |
| Drying | |

The treating solutions employed in respective treatment steps are as follows:

| Composition of color forming developing solution | |
|---|---|
| 4-Amino-3-methvl-N—ethyl-N—($\beta$-hydroxyethyl)-aniline sulfate | 4.75 g |
| Anhydrous sodium sulfite | 4.25 g |
| Hydroxylamine.½ sulfate | 2.0 g |
| Anhydrous potassium carbonate | 37.5 g |
| Sodium bromide | 1.3 g |
| Nitrotriacetic acid.3 sodium salt (monohydrate) | 2.5 g |
| Potassium hydroxide | 1.0 g |
| (Make up to one liter by addition of water) | |

-continued

| Composition of bleaching solution | |
|---|---|
| Ethylenediaminetetraacetic acid iron ammonium salt | 100.0 g |
| Ethylenediaminetetraacetic acid diammonium salt | 10.0 g |
| Ammonium bromide | 150.0 g |
| Glacial acetic acid | 10.0 ml |
| (Make up to one liter by addition of water, and adjust to pH 6.0 with ammonia water) | |
| Composition of fixing solution | |
| Ammonia thiosulfate | 175.0 g |
| Anhydrous sodium sulfate | 8.6 g |
| Sodium methasulfite | 2.3 g |
| (Make up to one liter by addition of water, and adjust to pH 6.0 with acetic acid) | |
| Composition of stabilizing solution | |
| Formalin (37% aqueous solution) | 1.5 ml |
| Konidax (produced by Konishiroku Photo Industry Co.) | 7.5 ml |
| (Make up to one liter by addition of water) | |

The photographic characteristics, sharpness and graininess were measured for the color images obtained, and the results obtained are shown in Table 2, in which the sensitivities are shown in terms of relative sensitivity to the sensitivity of Sample No. 1 as 100.

The DIR compound (A) employed in this Reference example has the following chemical structure:

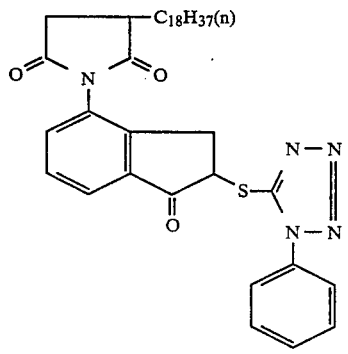

TABLE 2

| Sample No. | Em No. | Sensitivity | MTF value 10 lines/mm | MTF value 30 lines/mm | RMS |
|---|---|---|---|---|---|
| 1 | Em - 1 | 100 | 100 | 100 | 100 |
| 2 | Em - 2 | 165 | 83 | 77 | 72 |
| 3 | Em - 3 | 78 | 135 | 123 | 140 |
| 4 | Em - 4 | 108 | 122 | 106 | 120 |
| 5 | Em - 5 | 172 | 118 | 102 | 107 |
| 6 | Em - 6 | 82 | 142 | 130 | 144 |
| 7 | Em - 7 | 113 | 125 | 113 | 123 |
| 8 | Em - 8 | 196 | 123 | 116 | 110 |
| 9 | Em - 9 | 81 | 138 | 127 | 140 |
| 10 | Em - 10 | 110 | 122 | 109 | 123 |
| 11 | Em - 11 | 177 | 119 | 108 | 109 |

Example 1

In this Example, green sensitive color photographic materials containing a magenta coupler were prepared in the same manner as the Reference example except for using the emulsions as shown below.

| Em No. | Emulsions used |
|---|---|
| 12 | Em − 4 (80%) + Em − 5 (20%) |
| 13 | Em − 3 (80%) + Em − 5 (20%) |
| 14 | Em − 7 (80%) + Em − 8 (20%) |
| 15 | Em − 6 (80%) + Em − 8 (20%) |
| 16 | Em − 10 (80%) + Em − 11 (20%) |
| 17 | Em − 9 (80%) + Em − 11 (20%) |

(Note) the percentages in the brackets represent the mixing ratios of the respective emulsions.

The samples as prepared above were exposed and treated similarly as in the Reference example to obtain characteristic values thereof. The results are shown in Table 3.

TABLE 3

| Sample No. | Em No. | Sensitivity | MTF value 10 lines/mm | MTF value 30 lines/mm | RMS |
|---|---|---|---|---|---|
| 1 | Em - 1 | 100 | 100 | 100 | 100 |
| 12 | Em - 13 | 137 | 120 | 100 | 109 |
| 13 | Em - 14 | 130 | 132 | 110 | 120 |
| 14 | Em - 16 | 153 | 122 | 112 | 113 |
| 15 | Em - 17 | 142 | 137 | 125 | 127 |
| 16 | Em - 19 | 143 | 120 | 107 | 115 |
| 17 | Em - 20 | 130 | 133 | 118 | 126 |

As shown in Table 3, when grains smaller than 0.65μ are mixed with grains larger than 0.8μ (Sample No. 13, 15, 17), the sharpness of the image can be synergetically enhanced. Also, it can be seen that this effect is especially pronounced when employing monodispersed octahedral grains or monodispersed tetradecahedral grains.

Example 2

Each of Samples 18, 19, 20, 21, 22, 23 and 24 was prepared by coating the respective layers shown below successively from the side of the support on a support comprising a cellulose triacetate film on which a subbing treatment had been applied.

(Sample 18)

Layer 1—Halation preventive layer

An aqueous gelatin solution having dispersed black colloidal silver therein was coated to a dry film thickness of 2.0μ.

Layer 2—Red sensitive silver halide emulsion layer

Em - 1 was mixed with sensitizing dyes of anhydrous 9-ethyl-3,3'-di-(3-sulfopropyl)-4,5,4',5'-dibenzothiacarbocyanine hydroxide and anhydrous 5,5'-dichloro-9-ethyl-3,3'-di-(3-sulfopropyl)thiacarbocyanine hydroxide, followed by addition of the dispersion (C - 1) as hereinafter described. The thus prepared red sensitive silver halide emulsion was coated to a dry film thickness of 4.5μ.

Layer 3—Intermediate layer

An aqueous gelatin solution was coated to a dry film thickness of 1.0μ.

Layer 4—Green sensitive silver halide emulsion layer

Em - 1 was mixed with sensitizing dyes of anhydrous 5,5'-dichloro-9-ethyl-3,3'-di-(3-sulfopropyl)oxacarbocyanine hydroxide, anhydrous 5,5'-diphenyl-9-ethyl-3,3'-di(3-sulfopropyl)oxacarbocyanine and anhydrous 9-ethyl-3,3'-di-(3-sulfopropyl)-5,6,5',6'-dibenzooxacarbocyanine hydroxide, followed by addition of the dispersion (M - 1) as hereinafter described to prepare a green sensitive silver halide emulsion, which was then coated to a dry film thickness of 4.5μ.

Layer 5—Intermediate layer

An aqueous gelatin solution was coated to a dry film thickness of 1.0μ.

Layer 6—Yellow filter layer

An aqueous gelatin solution having yellow colloidal silver and 2,5-di-t-octylhydroquinone therein was coated to a dry film thickness of 1.2μ.

Layer 7—Blue sensitive silver halide emulsion layer

Em - 1 was mixed with the dispersion (Y - 1) as described below and 1,2-bisvinylsulfonylethane to prepare a blue sensitive silver halide emulsion layer, which was coated to a dry film thickness of 5.0μ.

Layer 8—Protective layer

An aqueous gelatin solution containing 1,2-bisvinylsulfonylethane was coated to a dry film thickness of 1.2μ.

(Sample - 19)

Layer - 1: Halation preventive layer (the same as Layer 1 in Sample - 18).

Layer - 2: Red sensitive silver halide emulsion layer.

Em - 15 was formulated and coated similarly as in Layer - 2 in Sample - 18.

Layer - 3, Layer - 4, Layer - 5, Layer - 6, Layer - 7 and Layer - 8 were prepared and coated similarly as Layer - 3, Layer - 4, Layer - 5, Layer - 6, Layer - 7 and Layer - 8 in Sample - 18, respectively.

(Sample - 20)

The respective layers of Sample - 21 were provided by coating successively on a cellulose triacetate support in the same manner as in Sample 18, except that Em - 15 was formulated and coated similarly as in Layer - 3 of Sample 18, to prepare Sample - 20.

(Sample - 21)

Sample - 21 was prepared by providing coatings successively on a celulose triacetate support in the same manner as in Sample - 18, except that the same emulsion as in Layer - 2 of Sample - 19 was coated as the red sensitive emulsion layer of Layer - 2 and the same emulsion as in Layer - 4 of Sample - 20 was coated as the green sensitive emulsion layer of Layer - 4.

(Sample - 22)

The respective layers of Sample - 18 were provided by coating successively on a cellulose triacetate support in the same manner as in Sample 18, except that Em - 15 was formulated and coated similarly as in Layer - 7 of Sample 18, to prepare Sample - 22.

(Sample - 23)

Sample - 23 was prepared by providing coatings successively on a cellulose triacetate support in the same manner as in Sample 18, except that the same emulsion as in Layer - 4 of Sample - 20 was coated as the green sensitive emulsion layer of Layer - 4 and the same emulsion as in Layer - 7 of Sample - 22 was coated as the blue sensitive emulsion layer of Layer - 7.

(Sample - 24)

Sample - 24 was prepared by providing coatings successively on a cellulose triacetate support in the same manner as in Sample - 18, except that the same emulsion as in Layer - 2 of Sample - 19 was coated as the red sensitive emulsion layer of Layer - 2, the same emulsion as in Layer - 4 of Sample - 20 was coated as the green sensitive emulsion layer of Layer - 4 and the same emulsion as in Layer - 7 of Sample - 22 was coated as the blue sensitive emulsion layer of Layer - 7.

The couplers, colored couplers and the methods for preparation of the dispersions thereof are shown below.

Y - 1:
α-[4-(1-benzyl-2-]hexyl-3,5-dioxo-1,2,4-triazolidinyl)-]pivalyl-2-chloro-5-[γ-2,4-di-t-amylphenoxy)-butylamido]acetanilide M - 1:
1-(2,4,6-trichlorophenyl)-3-[3-(2,4-di-t-amylphenoxyacetamido)benzamido]-5-pyrazolone M - 3:
4,4'-methylenebis{1-(2,4,6-trichlorophenyl)-3-[3-(2,4-di-t-amylphenoxyacetamido)benzamido]-5-pyrazolone}

CM - 1:
1-(2,4,6-trichlorophenyl)-4-(1-naphthylazo)-3-(2-chloro-5-octadecenylsuccinimidoanilino)-5-pyrazolone C - 1:
1-hydroxy-4-[β-methoxyethylaminocarbonylmethoxy)-N-[δ-(2,4-di-tert-amylphenoxy)butyl]-2-naphthoamide CC - 1:
1-hydroxy-4-[4-(1-hydroxy-8-acetamido-3,6-disulfo-2-naphthylazo)phenoxy]-N-[δ-(2,4-di-t-amylphenoxy)butyl]-2-naphthoamide disodium salt Dispersion (Y - 1):

As a yellow dye forming coupler, 300 g of the above (Y - 1) was dissolved under heating in 150 g of dibutyl phthalate (DBP) and 500 ml of ethyl acetate and the resultant solution was added to 1600 ml of a 7.5% gelatin solution containing 18 g of sodium triisopropylnaphthalenesulfonate, and the mixture was emulsified in a colloid mill and made up to 2500 ml.

Dispersion (M - 1):

As a magenta dye forming coupler, 45 g of the above (M - 1), 18 g of (M - 2) and 14 g of (CM - 1) were dissolved under heating in 77 g of tricresyl phosphate and 280 ml of ethyl acetate, and the resultant solution was added to 500 ml of a 7.5% gelatin solution containing 8 g of sodium triisopropylnaphthalenesulfonate, and the mixture was emulsified in a colloid mill and made up to 1000 ml.

Dispersion (C - 1):

As a cyan dye forming coupler, 50 g of the above (C - 1), and as a colored cyan coupler, 4 g of (CC - 1), were dissolved under heating in a mixture of 55 g of tricresyl phosphate and 110 ml of ethyl acetate, and the resultant solution was added to 400 ml of a 7.5% gelatin solution containing 4 g of sodium triisopropylnaphthalene sulfonate and the mixture was emulsified in a colloid mill, followed by making up to 1000 ml.

These samples were exposed through a wedge to white light and thereafter subjected to developing treatments with CNK - 4 color treating solution produced by Konishiroku Photo Industry Co. The photographic characteristics obtained are shown in Table 4.

Detection of the improved effect of image sharpness was done by determining MTF (Modulation Transfer Function) and comparing the largeness of MTF at the space frequency of 40 lines/mm in terms of a relative value to the MTF value of Sample 18 as 100.

TABLE 4

| Sample No. | Blue sensitive emulsion layer | | | Green sensitive emulsion layer | | | Red sensitive emulsion layer | | |
|---|---|---|---|---|---|---|---|---|---|
| | Fog | Relative sensitivity | Sharpness | Fog | Relative sensitivity | Sharpness | Fog | Relative sensitivity | Sharpness |
| 18 | 0.05 | 100 | 100 | 0.04 | 100 | 84 | 0.04 | 100 | 71 |
| 19 | 0.05 | 100 | 100 | 0.04 | 101 | 84 | 0.04 | 100 | 78 |
| 20 | 0.05 | 100 | 100 | 0.04 | 102 | 97 | 0.03 | 107 | 79 |
| 21 | 0.05 | 100 | 100 | 0.04 | 102 | 97 | 0.03 | 100 | 87 |
| 22 | 0.06 | 103 | 152 | 0.03 | 101 | 116 | 0.04 | 101 | 93 |
| 23 | 0.06 | 103 | 152 | 0.04 | 101 | 123 | 0.03 | 101 | 109 |
| 24 | 0.06 | 103 | 152 | 0.03 | 102 | 123 | 0.03 | 101 | 114 |

As shown in Table 4, marked improved effects of sharpness can be seen in the samples according to the present invention (Samples 22, 23, 24, 25, 26 and 27). Particularly, when a normal crystal emulsion is employed in the blue sensitive emulsion layer which is the uppermost layer, improvements of sharpness are marked not only in said blue sensitive layer but also in the green sensitive emulsion layer located at lower part than said layer. Also, even when a normal crystal emulsion is employed only in the green sensitive emulsion layer, improvement of the image quality of said layer influencing the final image quality level as well as improvement of sharpness of the red sensitive layer could be seen. Further, when all layers are constituted of normal crystalline silver halide grains, it can be seen that the effect of improvement of sharpness is the most prominent.

We claim:

1. A multi-layer light-sensitive silver halide color photographic material having a plurality of light-sensitive silver halide emulsion layers on a support and having color couplers in said material, each of said silver halide emulsion layers having sensitivity to light at different spectral regions, wherein at least 80% of the total number of silver halide grains contained in at least one of said silver halide emulsion layers comprise 5–30% of silver halide grains having grain sizes greater than 0.8μ and 95–70% of silver halide grains smaller than 0.65μ.

2. The color photographic material of claim 1, wherein one of said at least one silver halide emulsion layers is located at the side remotest from the support or at least one of said silver halide emulsion layers is sensitive to green light or one of said at least one silver halide emulsion layers is located at the side remotest from the support and at least one of said silver halide emulsion layers is sensitive to green light.

3. The color photographic material of claim 1, wherein the silver halide grains having grain sizes greater than 0.8μ and the silver halide grains having grain sizes smaller than 0.65μ comprise normal crystals containing substantially no twin crystals.

4. The color photographic material of claim 2, wherein the silver halide grains having grain sizes greater than 0.8μ and the silver halide grains having grain sizes smaller than 0.65μ comprise normal crystals containing substantially no twin crystals.

5. The color photographic material of claim 3, wherein at least one of said silver halide grains having grain sizes greater than 0.8μ and said silver halide grains having grain sizes smaller than 0.65μ are at least one type of grain selected from the group consisting of octahedral grains and tetradecahedral grains.

6. The color photographic material of claim 4, wherein at least one of said silver halide grains having grain sizes greater than 0.8μ and said silver halide grains having grain sizes smaller than 0.65μ are at least one type of grain selected from the group consisting of octahedral grains and tetradecahedral grains.

7. The color photographic material of claim 1, wherein at least one of said silver halide grains having grain sizes greater than 0.8μ and said silver halide grains having grain sizes smaller than 0.65μ are monodispersed grains satisfying the following condition:

$$\frac{S}{\bar{r}} \leqq 0.15$$

wherein $$\bar{r}\ \text{(means grain diameter)} = \frac{\Sigma\, n_i r_i}{\Sigma\, n_i}\ ;\ \text{and}$$

$$S\ \text{(standard deviation)} = \sqrt{\frac{\Sigma\,(\bar{r} - r_i)^2\, n_i}{\Sigma\, n_i}}$$

and wherein $r_i$ is the size of the individual grain and $n_i$ is the number of grains having a size of $r_i$.

8. The color photographic material of claim 2, wherein at least one of said silver halide grains having grain sizes greater than 0.8μ and said silver halide grains having grain sizes smaller than 0.65μ are monodispersed grains satisfying the following condition:

$$\frac{S}{\bar{r}} \leqq 0.15$$

wherein $$\bar{r}\ \text{(means grain diameter)} = \frac{\Sigma\, n_i r_i}{\Sigma\, n_i}\ ;\ \text{and}$$

$$S\ \text{(standard deviation)} = \sqrt{\frac{\Sigma\,(\bar{r} - r_i)^2\, n_i}{\Sigma\, n_i}}$$

and wherein $r_i$ is the size of the individual grain and $n_i$ is the number of grains having a size of $r_i$.

9. The color photographic material of claim 3, wherein at least one of said silver halide grains having grain sizes greater than 0.8μ and said silver halide grains having grain sizes smaller than 0.65μ are monodispersed grains satisfying the following condition:

$$\frac{S}{\bar{r}} \leqq 0.15$$

wherein $$\bar{r}\text{ (means grain diameter)} = \frac{\Sigma n_i r_i}{\Sigma n_i}\text{; and}$$

$$S\text{ (standard deviation)} = \sqrt{\frac{\Sigma (\bar{r} - r_i)^2 n_i}{\Sigma n_i}}$$

and wherein $r_i$ is the size of the individual grain and $n_i$ is the number of grains having a size or $r_i$.

10. The color photographic material of claim 4, wherein at least one of said silver halide grains having grain sizes greater than 0.8μ and said silver halide grains having grain sizes smaller than 0.65μ are monodispersed grains satisfying the following condition:

$$\frac{S}{\bar{r}} \leqq 0.15$$

wherein $$\bar{r}\text{ (means grain diameter)} = \frac{\Sigma n_i r_i}{\Sigma n_i}\text{; and}$$

$$S\text{ (standard deviation)} = \sqrt{\frac{\Sigma (\bar{r} - r_i)^2 n_i}{\Sigma n_i}}$$

and wherein $r_i$ is the size of the individual grain and $n_i$ is the number of grains having a size or $r_i$.

11. The color photographic material of claim 5, wherein at least one of said silver halide grains having grain sizes greater than 0.8μ and said silver halide grains having grain sizes smaller than 0.65μ are monodispersed grains satisfying the following condition:

$$\frac{S}{\bar{r}} \leqq 0.15$$

wherein $$\bar{r}\text{ (means grain diameter)} = \frac{\Sigma n_i r_i}{\Sigma n_i}\text{; and}$$

$$S\text{ (standard deviation)} = \sqrt{\frac{\Sigma (\bar{r} - r_i)^2 n_i}{\Sigma n_i}}$$

and wherein $r_i$ is the size of the individual grain and $n_i$ is the number of grains having a size or $r_i$.

12. The color photographic material of claim 6, wherein at least one of said silver halide grains having grain sizes greater than 0.8μ and said silver halide grains having grain sizes smaller than 0.65μ are monodispersed grains satisfying the following condition:

$$\frac{S}{\bar{r}} \leqq 0.15$$

wherein $$\bar{r}\text{ (means grain diameter)} = \frac{\Sigma n_i r_i}{\Sigma n_i}\text{; and}$$

$$S\text{ (standard deviation)} = \sqrt{\frac{\Sigma (\bar{r} - r_i)^2 n_i}{\Sigma n_i}}$$

and wherein $r_i$ is the size of the individual grain and $n_i$ is the number of grains having a size or $r_i$.

13. The color photographic material of claim 1 comprising a blue-sensitive silver halide emulsion layer having sensitivity to light in the wavelength region of 400 to 500 mμ, a green sensitive silver halide emulsion layer having sensitivity to light in the wavelength region of 500 to 600 mμ and a red-sensitive silver halide emulsion layer having sensitivity to light in the wavelength region of 600 to 700 mμ.

14. The color photographic material of claim 2 comprising a blue-sensitive silver halide emulsion layer having sensitivity to light in the wavelength region of 400 to 500 mμ, a green sensitive silver halide emulsion layer having sensitivity to light in the wavelength of 500 to 600 mμ and a red-sensitive silver halide emulsion layer having sensitivity to light in the wavelength region of 600 to 700 mμ.

15. The color photographic material of claim 11 comprising a blue-sensitive silver halide emulsion layer having sensitivity to light in the wavelength region of 400 to 500 mμ, a green sensitive silver halide emulsion layer having sensitivity to light in the wavelength region of 500 to 600 mμ and a red-sensitive silver halide emulsion layer having sensitivity to light in the wavelength region of 600 to 700 mμ.

16. The color photographic material of claim 1, wherein said silver halide emulsion layer contains up to 4 mole % of silver iodobromide grains.

17. The color photographic material of claim 2, wherein said silver halide emulsion layer contains up to 4 mole % of silver iodobromide grains.

18. The color photographic material of claim 5, wherein said silver halide emulsion layer contains up to 4 mole % of silver iodobromide grains.

19. The color photographic material of claim 7, wherein said silver halide emulsion layer contains up to 4 mole % of silver iodobromide grains.

20. The color photographic material of claim 12, wherein said silver halide emulsion layer contains up to 4 mole % of silver iodobromide grains.

* * * * *